United States Patent [19]

Bryand et al.

[11] Patent Number: 4,542,596

[45] Date of Patent: Sep. 24, 1985

[54] HONEYCOMB GRILLED CONDUIT

[75] Inventors: Edward T. Bryand, Saco; Kenneth R. Randall, Gorham, both of Me.

[73] Assignee: Honeycomb Systems, Inc., Biddeford, Me.

[21] Appl. No.: 632,313

[22] Filed: Jul. 19, 1984

[51] Int. Cl.[4] ..... F26B 13/00

[52] U.S. Cl. ..... 34/115; 34/122; 34/155

[58] Field of Search ..... 34/110, 114, 115, 121, 34/122, 155, 156, 162, 163

[56] References Cited

U.S. PATENT DOCUMENTS

| | | | |
|---|---|---|---|
| 2,864,176 | 12/1958 | Backlert et al. | 34/122 |
| 2,882,614 | 4/1959 | Charlton et al. | 34/155 |
| 3,276,140 | 10/1966 | Walser et al. | 34/110 |
| 3,303,575 | 2/1967 | Gistren | 34/115 |
| 3,447,247 | 6/1969 | Daane | 34/122 |
| 3,592,585 | 7/1971 | Candor et al. | 34/155 |
| 3,752,639 | 8/1973 | Thagard | 34/122 |
| 4,251,927 | 2/1981 | Luthi | 34/110 |

FOREIGN PATENT DOCUMENTS

| | | | |
|---|---|---|---|
| 2000436 | 7/1971 | Fed. Rep. of Germany | 34/110 |

*Primary Examiner*—Larry I. Schwartz
*Assistant Examiner*—David W. Westphal
*Attorney, Agent, or Firm*—J. W. Molasky

[57] ABSTRACT

A honeycomb grilled conduit is constructed of a channel having a pair of spaced-apart sidewall portions defining a channel opening with a honeycomb grill extending across the channel opening between the outer edges of the sidewall portions. The honeycomb grill of the conduit is raised outwardly of the edges of the sidewall portions so as to provide between the honeycomb grills of adjacent conduits an open flow area for the flow of the drying medium so as to provide a continuous drying surface.

12 Claims, 8 Drawing Figures

FIG. 6
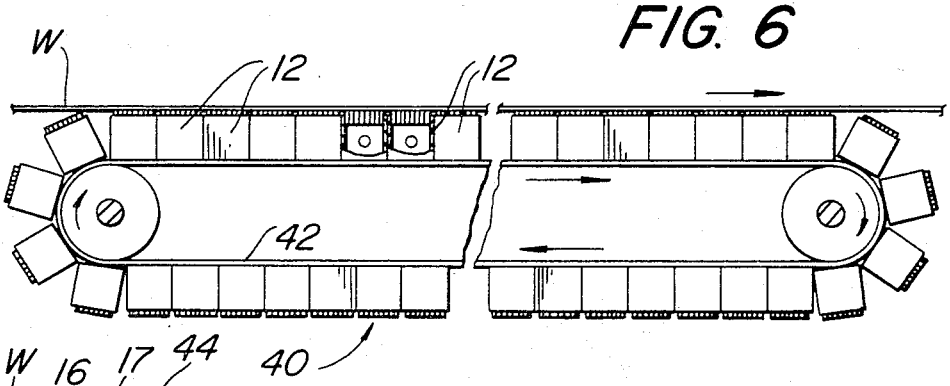
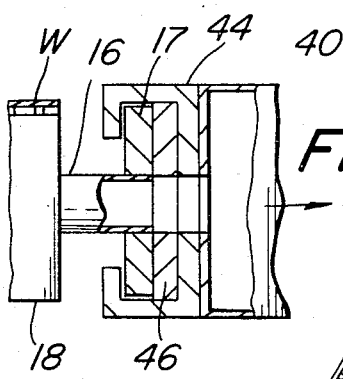
FIG. 6A
FIG. 7
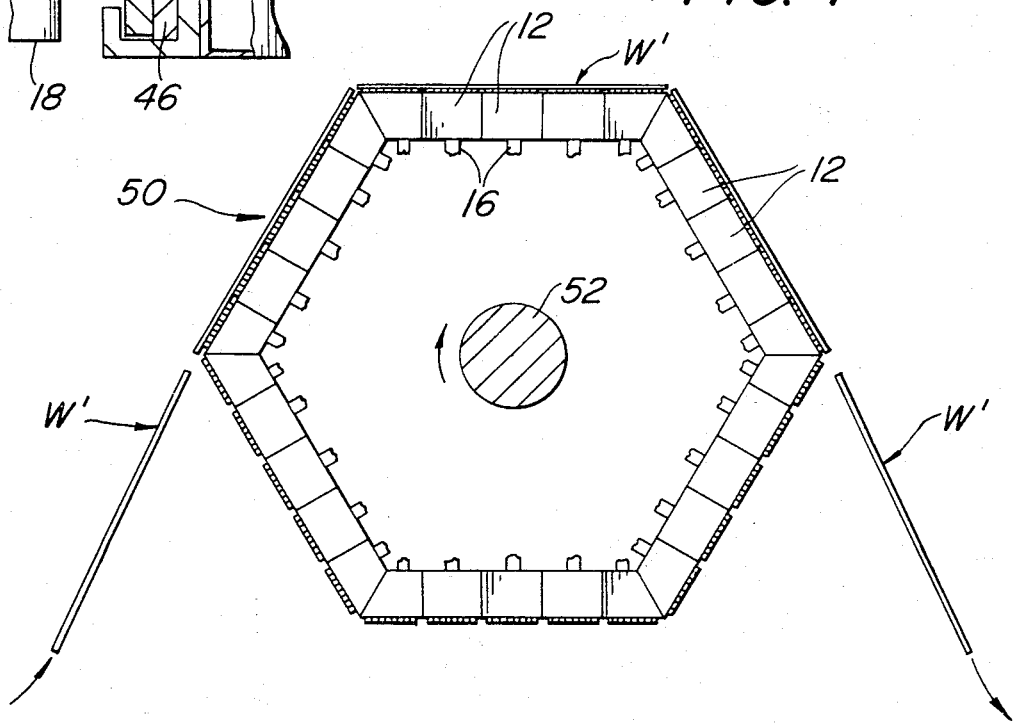

HONEYCOMB GRILLED CONDUIT

BACKGROUND AND SUMMARY OF THE INVENTION

This invention relates to honeycomb grilled conduits of the type used for vacuum applications such as the drying of a paper web.

Honeycomb grilled conduits of the indicated type generally comprise a channel to which a vacuum is applied and a honeycomb grill extending across the open portion of the channel. A vacuum is applied to the interior of the channel to draw the drying medium through the web to be dried and the honeycomb grill. In use, a plurality of the conduits are placed in side-by-side relation to provide an extended drying surface with the sidewalls of adjacent channels extending alongside one another. By reason of this arrangement, a dividing line is formed where the channels are joined because in the present-day grilled conduits the honeycomb grill is mounted to be flush with the end of the channel on which it is supported. The result is that there is formed a blind spot to the flow of drying medium being drawn into the interior of the channels by reason of the vacuum applied thereto. This blind spot is located along the dividing line where adjacent conduits are mated to form the extending drying surface. This leads to drying nonuniformities and hence undesirable web properties such as cockling and scorching. Cockling is the fault due to differences in tension set up during drying whenever the drying rate is different in one portion of the web to adjacent portions. Scorching is caused by overdrying portions of the web in order to reduce peak moisture areas. Overdrying causes the web to heat up to the supply air temperature thereby causing discoloration of the web by oxidation.

It is the general object of the invention to provide a honeycomb grilled conduit of the indicated type which eliminates the blind spot formed at the location where adjacent conduits mate.

Briefly stated, the general object of the invention is achieved by the provision of a grilled conduit means which comprises a plurality of conduits each of which includes means providing a channel having a pair of spaced apart sidewall portions defining a channel opening, the channel having a passage through which a vacuum can be applied to the interior of the channel. Each conduit also comprises a honeycomb grill extending across the channel opening between the outer edges of the sidewall portions, the honeycomb grill having a plurality of open cells therein for the flow of the drying medium into the interior of the channel. The plurality of conduits are mounted in side-by-side relation with sidewalls of adjacent conduits being juxtapositioned to provide a dividing line region therebetween and an extended drying surface. Pursuant to the invention, the honeycomb grill of each conduit is raised outwardly of the edges of the sidewall portions to provide between adjacent honeycomb grills an open flow area for the flow of the drying medium in the dividing line region beyond the sidewall edges of juxtapositioned sidewall portions. By this construction a continuous drying surface is provided.

BRIEF DESCRIPTION OF THE DRAWINGS

FIG. 6 is a elevational view of a traveling belt type of dryer comprising honeycomb grilled conduits in accordance with the invention.

FIG. 6A is a fragmentary view of a detail of the embodiment shown in FIG. 6.

FIG. 7 is an elevational view of a rotating polygonal cylinder comprising honeycomb grilled conduits in accordance with the invention.

DETAILED DESCRIPTION OF THE PREFERRED EMBODIMENTS

Figure 1:
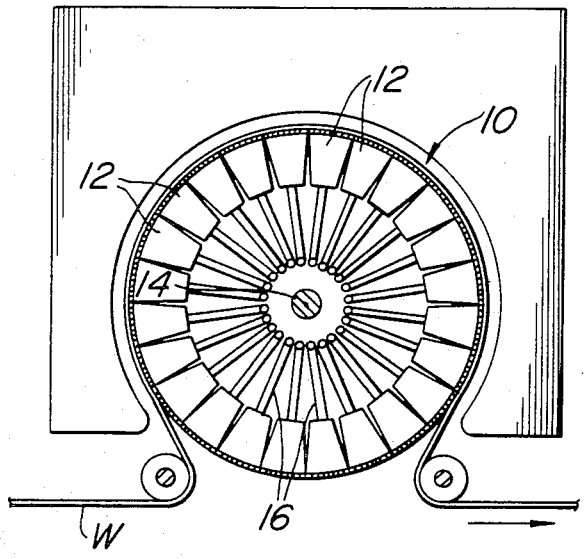
FIG. 1 is an elevational view of a drying cylinder for use in the drying of a paper web or the like made up of a plurality of honeycomb grilled conduits in accordance with the invention.

The drying cylinder shown in FIG. 1 is a generally conventional arrangement in which a cylinder 10 is formed of a plurality of conduits 12 arranged together in a cylindrical configuration. In the present design the conduits 12 are not directly physically connected together but are bolted on the bottom to a series of rings spaced across the width. The cylinder 10 is mounted for rotation on an axle 14 and has a paper web W fed therearound by a conventional guideroll arrangement as is well known in the art. Each of the conduits 12 has a vacuum pressure applied to its interior channel through radially extending vacuum supply tubes 16 adapted to communicate with a vacuum source at their inner ends as cylinder 10 rotates as is conventional in the art.

Each of the conduits 12 is constructed of a U-shaped channel 18 having a pair of spaced-apart sidewall portions 20 and a bottom wall 24. A channel opening extends between the outer edges of the sidewall portions 20. The channel 18 is closed at its ends by endwall portions 26. The channel 18 has an opening 28 in its bottom wall 24 providing a passage through which a vacuum can be applied to the interior thereof by way of a vacuum supply tube 16.

There is provided a honeycomb grill 30 that extends across the channel opening between the outer edges of the sidewall portions 20. The honeycomb grill 30 has a plurality of open hexagonal-shaped cells therein for the flow of the drying medium from the exterior of the conduit 12 into the interior of the channel. Grill 30 is spot welded to sidewall portions 20 at their inner surfaces. Honeycomb grills of the type shown in the Drawing are well known. Preferably, grill 30 has an arcuate configuration.

It will be apparent with the conduits 12 mounted in side-by-side relation with the sidewall portions 20 of adjacent conduits 12 juxtapositioned, as shown in FIG. 1, for example, there is provided a dividing line region between adjacent sidewall portions 20. There is also provided an extended drying surface extending across the adjacent honeycomb grills 30.

In accordance with the invention the honeycomb grill 30 of each conduit 12 is raised outwardly of the outer edges of the sidewall portions 20 to provide between adjacent honeycomb grills 30 an open flow area for the flow of drying medium in the dividing line region beyond said outer edges of juxtapositioned sidewall portions 20 to thereby provide a continuous drying surface. In the embodiment of the invention shown in FIGS. 2 and 3, each of the honeycomb grills 30 is arranged to extend outwardly from the inner surface of the sidewall portions 20 so that a space is provided between the honeycomb grills 30 of adjacent conduits 12. By reason of this construction, there will be no blind spots formed to the flow of drying medium being drawn into the interior of the channel 18 by the vacuum applied thereto. Accordingly, the drying of the paper web will be uniform throughout its extent and no undried areas will be formed along the dividing line.

Figure 2:
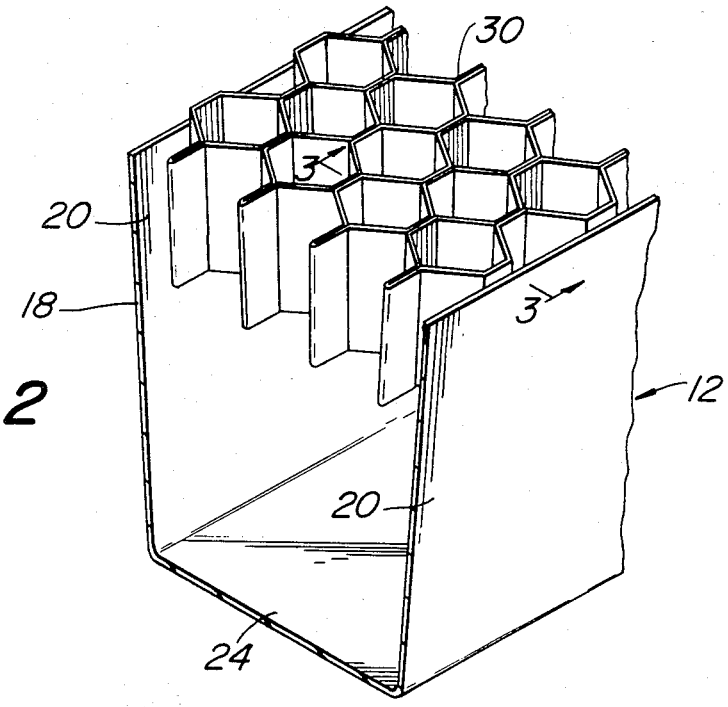
FIG. 2 is a fragmentary perspective view of a honeycomb grilled conduit in accordance with the invention.
Figure 3:
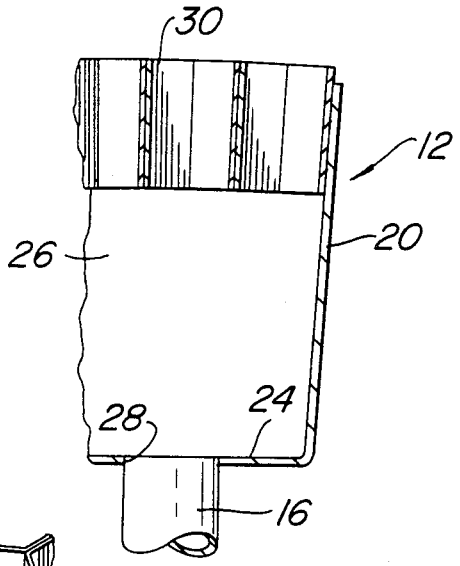
FIG. 3 is a sectional view taken on line 3—3 of FIG. 2.
Figure 4:
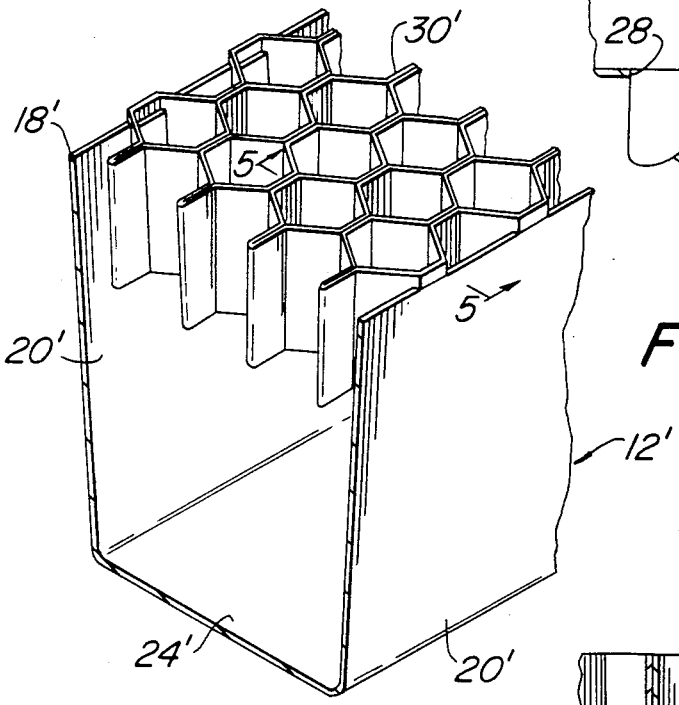
FIG. 4 is a fragmentary perspective view of another form of honeycomb grilled conduit in accordance with the invention.
Figure 5:
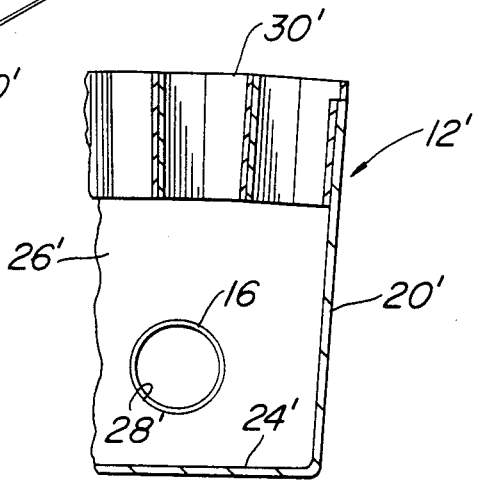
FIG. 5 is a sectional view taken on line 5—5 of FIG. 4.

In the embodiment of the invention shown in FIGS. 4 and 5 there is provided a conduit 12' essentially the same as that shown in FIGS. 2 and 3. The only essential difference in this construction is that the honeycomb grill 30' of each conduit 12' sits over the outer edge of the sidewall portions 20' thereof and is constructed and arranged to mate with the honeycomb grill 30' of an adjacent conduit to thereby define honeycomb cell portions in the dividing line region for the flow of the drying medium. In FIGS. 4 and 5 corresponding parts have been given the same reference numerals as the parts shown in FIGS. 2 and 3 with primes added. Another difference in the embodiment shown in FIGS. 3 and 4 is that the passage 28' through which a vacuum is applied to the interior of the channel 18' is located in an endwall portion 26' as is shown in FIG. 5 and not in bottom wall 24'.

The manner in which the vacuum is applied to the vacuum supply tubes 16 is well known in the art. Briefly, each tube 16 is terminated on a rotating manifold which mates with the vacuum arc of the dryer through a stationary axial seal and a stationary exhaust plenum. The exhaust plenum is connected to the vacuum source by piping. One such vacuum supply means is incorporated in the high vacuum rotary through dryers manufactured by Honeycomb Systems, Inc. and sold under the name "THRU-DRYER".

In FIG. 6 there is shown a grilled conduit means in accordance with the invention wherein a plurality of the conduits 12 are arranged in an endless belt configuration to form a traveling belt construction 40. In this embodiment of the invention, the web W is fed in a straight path across the straight portion of the traveling belt formed by conduits 12 which are mounted for movement on an endless belt means 42 as is shown in FIG. 6.

The application of the vacuum of the conduits 12 in FIG. 6 is illustrated in FIG. 6A. In accordance with this construction, each exhaust tube 16 is located in an endwall portion of the channel 18 and has a flange 17 mated thereto. The arrangement is such that as each channel 18 traverses into the vacuum zone of the dryer, the flange 17 is captured in an exhaust plenum 44 and mates against a stationary seal 46. The flanges 17 of adjacent channels 18 are butted together so that there is no gap existing so as to eliminate any possible ambient air leakage.

In FIG. 7 there is shown a conduit means in accordance with the invention wherein a plurality of the conduits 12 are arranged in a polygonal configuration, namely, a hexagon, to form a dryer 50. The polygonal configuration is mounted for rotation about an axle 52. In the use of this form of the invention the sheets of a discontinuous web W are placed onto a straight side of the hexagon configuration for drying thereof as is shown in FIG. 7. As each sheet is placed onto a side of the hexagon configuration, the dryer is indexed one-sixth of a revolution, after which the next sheet is placed on an uncovered side of the dryer, and so on as is shown in FIG. 7. A vacuum is applied to the vacuum supply tubes 16 in the same manner as described above with respect to the embodiment of the invention shown in FIGS. 1–5.

What is claimed is:

1. A grilled conduit means for use in drying a paper web or the like comprising:

a plurality of independent conduits each of which includes means providing a channel having a pair of fixed spaced apart sidewall portions having outer edges defining a channel opening extending therebetween, said channel providing an enclosed constant volume interior chamber within said sidewall portions and having a passage through which a vacuum can be applied to the interior chamber, each of said sidewall portions having an inner surface facing the interior chamber, and a honeycomb grill fixedly mounted on each channel providing means to extend across said channel opening and being in contact with portions of said inner surfaces adjacent said outer edges of said sidewall portions, said honeycomb grill having a plurality of open cells therein through which a drying medium can flow into the interior chamber of said channel, said conduits being mounted in side-by-side relation with the sidewalls of adjacent conduits being juxtapositioned to provide a dividing line region therebetween and with said honeycomb grills providing an extended drying surface, said honeycomb grill of each conduit being raised outwardly of said outer edges of said sidewall portions from the inner surfaces thereof to provide between adjacent honeycomb grills an open flow area for the flow of drying medium in said dividing line region beyond said edges of juxtapositioned sidewall portions whereby a continuous drying surface is provided.

2. A grilled conduit means according to claim 1 wherein each of said honeycomb grills is arranged to extend outwardly from the inner surface of said sidewall portion so that a space is provided between the honeycomb grills of adjacent conduits.

3. A conduit means according to claim 2 wherein said conduits are arranged with said honeycomb grills providing a cylindrical surface whereby a drying cylinder is formed.

4. A grilled conduit means according to claim 2 wherein said conduits are arranged in an endless belt configuration to form a travelling belt construction.

5. A grilled conduit means according to claim 2 wherein said conduits are arranged in a polygon configuration.

6. A grilled conduit means according to claim 1 wherein said honeycomb grill of each conduit sits over the outer edge of the sidewall portions thereof and is constructed and arranged to mate with the honeycomb grill of an adjacent conduit to define honeycomb cell portions in the dividing line region for the flow of drying medium.

7. A conduit means according to claim 6 wherein said conduits are arranged with said honeycomb grills providing a cylindrical surface whereby a drying cylinder is formed.

8. A grilled conduit means according to claim 6 wherein said conduits are arranged in an endless belt configuration to form a travelling belt construction.

9. A grilled conduit means according to claim 6 wherein said conduits are arranged in a polygon configuration.

10. A conduit means according to claim 1 wherein said conduits are mounted in fixed relation to one another and are arranged with said honeycomb grills providing a cylindrical surface whereby a drying cylinder is formed.

11. A grilled conduit means according to claim 1 wherein said conduits are arranged in an endless belt configuration to form a traveling belt construction.

12. A grilled conduit means according to claim 1 wherein said conduits are mounted in fixed relation to one another and are arranged in a polygon configuration.

* * * * *